US006786282B2

(12) United States Patent
Begg et al.

(10) Patent No.: US 6,786,282 B2
(45) Date of Patent: Sep. 7, 2004

(54) MILLING APPARATUS AND METHOD FOR A WELL

(75) Inventors: Stephen M. Begg, Edmonton (CA); Herve Ohmer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 8 days.

(21) Appl. No.: 10/178,210

(22) Filed: Jun. 24, 2002

(65) Prior Publication Data

US 2003/0010497 A1 Jan. 16, 2003

Related U.S. Application Data

(60) Provisional application No. 60/300,678, filed on Jun. 25, 2001.

(51) Int. Cl.[7] ..... E21B 7/06; E21B 7/08

(52) U.S. Cl. ..... 166/297; 166/117.5; 166/50; 166/55.7; 175/61

(58) Field of Search ..... 166/117.5, 117.6, 166/382, 50, 55.7, 255.3, 297, 313; 175/61, 79, 80, 81, 82, 230

(56) References Cited

U.S. PATENT DOCUMENTS

| | | | | |
|---|---|---|---|---|
| 2,170,284 A | * | 8/1939 | Eastman | 166/117.6 |
| 2,207,920 A | | 7/1940 | Hughes | |
| 4,765,404 A | | 8/1988 | Bailey et al. | |
| 5,193,620 A | * | 3/1993 | Braddick | 166/382 |
| 5,431,219 A | | 7/1995 | Leising et al. | |
| 5,488,989 A | * | 2/1996 | Leising et al. | 166/255.3 |
| 5,743,331 A | * | 4/1998 | Adkins et al. | 166/55.7 |
| 5,816,324 A | | 10/1998 | Swearingen et al. | |
| 5,829,531 A | * | 11/1998 | Hebert et al. | 166/382 |
| 5,887,655 A | | 3/1999 | Haugen et al. | |
| 5,988,272 A | * | 11/1999 | Bruce | 166/55.6 |
| 6,105,675 A | | 8/2000 | Buytaert et al. | |
| 6,244,337 B1 | * | 6/2001 | Cumming et al. | 166/117.6 |
| 6,308,782 B1 | * | 10/2001 | Brooks et al. | 166/313 |
| 6,427,777 B1 | * | 8/2002 | Schick | 166/313 |
| 6,454,006 B1 | * | 9/2002 | Freeman et al. | 166/295 |
| 2002/0070018 A1 | * | 6/2002 | Buyaert | 166/255.3 |

* cited by examiner

*Primary Examiner*—David Bagnell
*Assistant Examiner*—Thomas Bomar
(74) *Attorney, Agent, or Firm*—Trop, Pruner & Hu, PC.; Jeffrey E. Griffin; Brigitte Jeffery Echols

(57) ABSTRACT

A downhole system includes a deflector with a reaction surface that is engageable to a mill. The deflector is coupled to a motion mechanism that is activable to move the deflector generally along a longitudinal direction. During operation, the mill is engaged to a surrounding downhole structure, and the mill is rotated. As the mill cuts an opening in the downhole structure, the motion mechanism moves the deflector, which allows the mill to move with the deflector. A smooth motion is provided by the motion mechanism to enable a more accurate cutting of the downhole structure (e.g., casing or liner).

38 Claims, 3 Drawing Sheets

MILLING APPARATUS AND METHOD FOR A WELL

CROSS REFERENCE TO RELATED APPLICATIONS

This claims the benefit under 35 U.S.C. § 119(e) of U.S. Provisional Application Serial No. 60/300,678, entitled "Milling and Completion System and Method for Multi-Lateral Wells," filed Jun. 25, 2001.

TECHNICAL FIELD

The invention relates to methods and apparatus for milling openings in downhole structures in a wellbore.

BACKGROUND

To produce hydrocarbons from an underground formation or to inject fluids into an underground formation, wellbores are drilled through the earth subsurface to the desired formation. Such wellbores may be vertical, deviated, or horizontal wellbores. Wells may also be multilateral wells, which have multiple lateral branches that extend from a parent wellbore (also referred to as the main bore).

After a wellbore has been drilled into the earth subsurface, it is typically lined with casing or another type of liner. Casing extends from the well surface some distance into the wellbore. In some wells, liners are also used to line other portions of a wellbore.

In some cases, it may be desirable to change the trajectory of a wellbore after the wellbore has been drilled and the casing or liner has been cemented in the wellbore. The change in trajectory may be desired to reach better producing zones of a formation. Further, lateral branches may be extended from a cased or lined main bore to provide a multilateral well.

To change the trajectory of the wellbore or to add a lateral branch, windows are formed in the casing or liner to enable drilling of the lateral bore. The casing or liner window is generally cut by a milling assembly having one or more mills. The peripheral surfaces of the mills are generally covered with abrasive or cutting inserts made of a hard material, such as sintered tungsten carbide compounds braised on a steel mandrel. The mills are designed to cut through a steel casing or liner. A whipstock is generally set in the wellbore before the milling assembly is run into the wellbore. The whipstock is located in the proximity of the region in which the lateral bore is to begin. The whipstock provides a slanted surface that guides the mills of the milling assembly into the adjacent casing or liner. The whipstock pushes the milling assembly towards the casing or liner wall under action of a downward force on the milling assembly.

Although a whipstock is expected to support some milling damage, it may be difficult to predict how much whipstock material is left after milling has been performed. In addition, after milling operations have been completed, it may be difficult to retrieve the damaged whipstock, which can lead to a major obstruction of the well and subsequent abandonment of the section of the well below the whipstock. In addition, conventional milling assemblies may not provide adequate control of the window geometry.

SUMMARY

In general, improved method and apparatus are provided for milling windows or other openings in well casings or liners or other downhole structures. For example, a milling apparatus to mill a window through a downhole structure having a longitudinal axis includes a deflector having a reaction surface, and a motion mechanism adapted to move the deflector generally along the longitudinal axis. A mill is adapted to be engaged with the reaction surface and to move generally along the longitudinal axis with the deflector.

Other features and embodiments will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "up" and "down"; "upper" and "lower"; "upwardly" and "downwardly"; "upstream" and "downstream"; "above" and "below"; and other like terms indicating relative positions above or below a given point or element are used in this description to more clearly describe some embodiments of the invention. However, when applied to equipment and methods for use in environments that are deviated or horizontal, such terms may refer to a left to right, right to left, or other relationship as appropriate.

A milling apparatus is provided to cut a more precise window or opening in a downhole structure, such as a casing or liner, as compared to conventional milling apparatus. According to some embodiments of the invention, the milling apparatus includes a deflector that has a reaction surface and a motion mechanism to move the deflector generally along a longitudinal axis of the deflector. A mill, via its support bearing, cooperates with the reaction surface, with the reaction surface forcing the mill against the casing or liner to enable the mill to cut the window in the casing or liner in a well-controlled radial direction. During milling, the motion mechanism moves the deflector generally longitudinally, with the mill moving with the deflector. The azimuthal orientation of the mill (the azimuthal direction in which the mill is radially directed) is defined by engagement of the milling apparatus with a landing device, as discussed further below.

In one embodiment, the motion mechanism includes a thruster assembly that has a hydraulic cylinder containing a hydraulic fluid (e.g., oil), with the hydraulic cylinder moveable along one or more support members as the hydraulic fluid is pushed out from the hydraulic cylinder. In other embodiments, other types of motion mechanisms can be employed to move the deflector generally longitudinally in the wellbore. The motion mechanism provides for smooth longitudinal movement of the mill in the milling assembly as the mill is rotated to cut a window in the downhole structure. This smooth movement of the mill allows for a more precise cut of the window.

Figure 1:
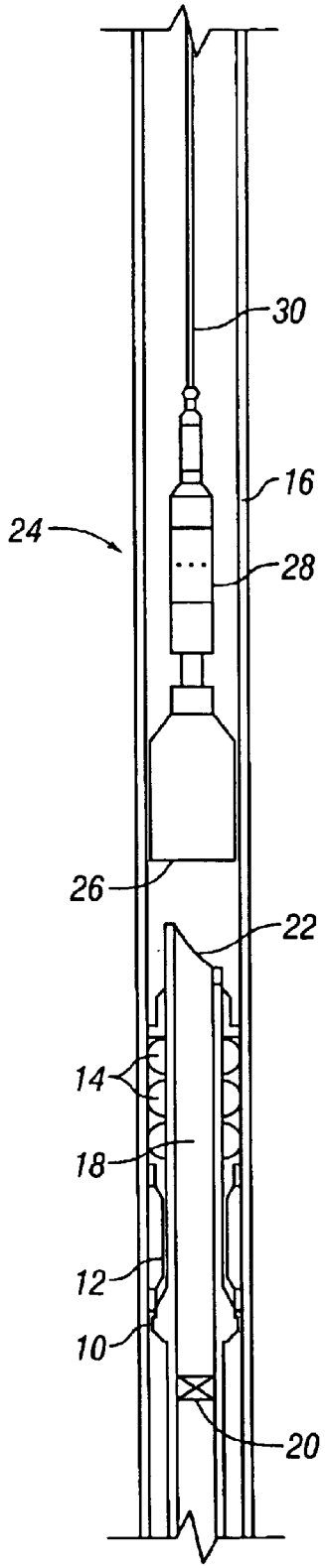
FIG. 1 illustrates a packer device set in a hole and a measurement device engagable with the packer device to measure an azimuthal orientation of the packer device.

FIG. 1 shows a packer device 10 that has been set in a wellbore. The packer device 10 is fixed at a given depth in the wellbore, with the packer device used to cooperate with a milling apparatus (described below) to mill a window through the surrounding casing or liner 16. In the ensuing description, the term "casing" is used to refer interchangeably to either a casing or liner.

The packer device 10 has anchor slips 12 and sealing elements 14 that engage the inner wall of the casing 16. The packer device 10 is lowered into the wellbore, with the slips 12 and sealing elements 14 set (either mechanically or hydraulically) to engage the inner wall of the casing 16. In another embodiment, instead of using the packer device 10, some other type of landing or anchor device can be used. For example, the casing 16 can have an inner profile (in the inner wall of the casing 16) at a predetermined depth, with the inner profile of the casing 16 engageable with corresponding mating elements (e.g., locking dogs) of the landing or anchor device to fix the landing or anchor device in the wellbore. In other embodiments, other types of landing or anchor devices can use other types of engagement mechanisms to allow the landing or anchor device to be set at a target wellbore depth. For example, a landing and orienting device that is part of the casing can also be used.

The packer device 10 has an inner bore 18 that is open to fluid communication with the wellbore. However, in the illustrated arrangement of the FIG. 1, a plug 20 is provided in the inner bore 18 of the packer device 10 to block fluid flow through the inner bore 18.

The upper end of the packer device 10 includes an orienting profile 22 (e.g., a muleshoe). The orienting profile 22 is adapted to engage a corresponding orienting element or profile of another tool that is subsequently lowered into the wellbore and engaged to the upper end of the packer device 10. The orienting profile 22 allows the subsequent tool to be oriented azimuthally in the wellbore. This allows the window in the casing 16 to be cut at a predetermined azimuthal orientation in the wellbore to direct the lateral wellbore along a certain direction.

As a packer device 10 is lowered into the wellbore, rotation of the packer device 10 occurs so that the exact azimuthal orientation of the packer device 10 is not known once it is set in the wellbore. To determine the azimuthal orientation of the packer device 10 after it has been set, an orientation measurement tool 24 is run into the wellbore. The orientation measurement tool 24 includes a guide device 26 that has an orienting element or profile (not shown) for corresponding engagement with the orienting profile 22 of the packer device 10. This allows the orientation measurement tool 24 to have a known or azimuthal relationship with respect to the packer device 10. The orientation measurement tool 24 includes a measurement device 28 for performing the actual azimuthal measurement. In one embodiment, the measurement device 28 includes a gyroscope survey device.

To provide power to the measurement device 28, electrical signaling and power is provided over a cable 30. In one embodiment, the cable 30 is a wireline. However, in other embodiments, other types of carriers are able to route electrical conductors to the orientation measurement tool 24.

After the orientation measurement tool 24 has been engaged with the packer device 10 and the measurement device 28 has been activated to take the azimuthal measurement, the measurement data is either recorded in the measurement device 28 or is communicated up the electrical cable 30 to surface equipment. In either case, the azimuthal orientation of the orienting profile 22 of the packer device 10 is now known. This allows subsequent tools to be oriented properly at the well surface before they are run into the wellbore.

Figure 2:
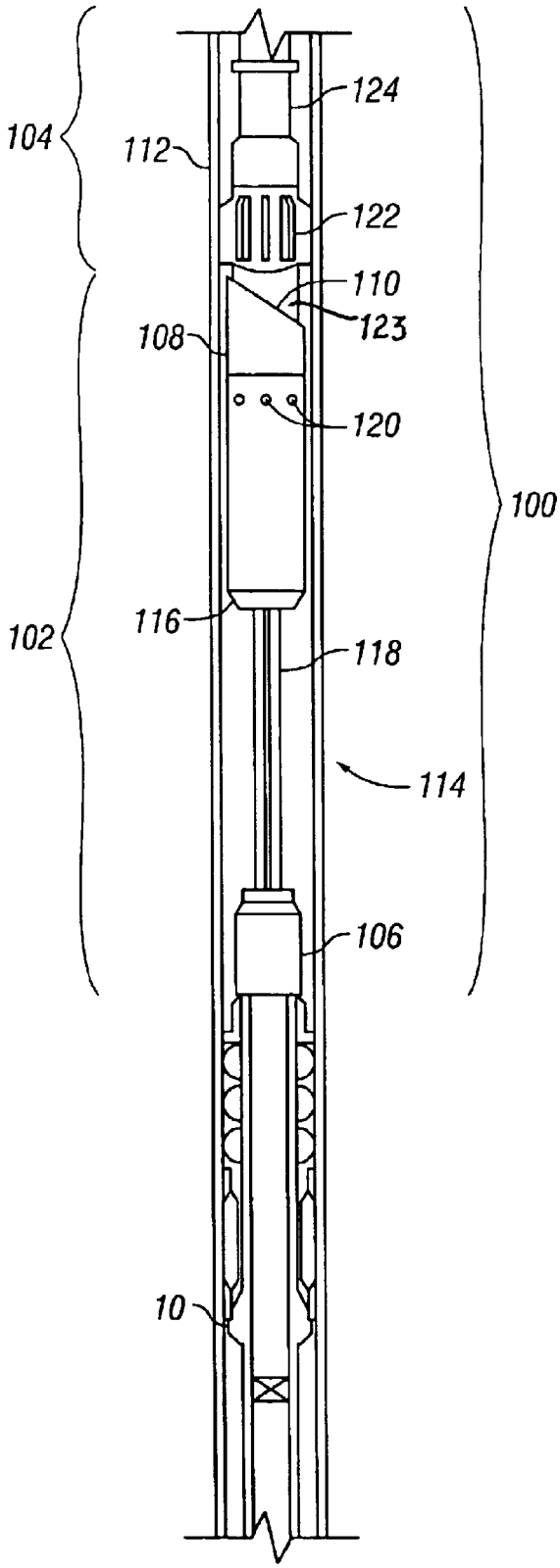
FIG. 2 illustrates a milling assembly engaged with the packer device of FIG. 1, with the milling apparatus in a first position.

Referring to FIG. 2, after the orientation measurement tool 24 has been retrieved or pulled out of the wellbore, a milling assembly 100 is run into the wellbore for engagement with the packer device 10. The milling assembly 100 includes a deflector assembly 102 and a milling tool 104. The deflector assembly 102 has a guide device 106 with an orienting element or profile for engagement with the orienting profile 22 at the upper end of the packer device 10. The deflector assembly 102 includes a deflector 108 having a reaction surface 110 for interaction or cooperation with a mill 112 of the milling tool 104 through a support bearing 123. The reaction surface is generally inclined or slanted. The lower end of the support bearing 123 engages the reaction surface to direct the mill 122 toward the casing 16 in a particular azimuthal direction, as determined by the relation of the guide device 106 to the orienting profile 22 of the packer device 10. Thus, effectively, the reaction of the mill assembly 104 and the deflector 108 causes a radial displacement of the mill, with the azimuthal orientation controlled by the packer device 10.

The deflector assembly 102 also includes a thruster section 114 that has a hydraulic cylinder 116 and one or more support members (in the form of rods 118). The hydraulic cylinder is moveable longitudinally along the rods 118. Initially, the hydraulic cylinder 116 is filled with a hydraulic fluid, such as oil. The hydraulic cylinder 116 includes outlet ports 120 through which the hydraulic fluid can be communicated to enable downward longitudinal movement of the hydraulic cylinder 116 along the support members 118.

The milling tool 104 includes the mill 112 that has a plurality of cutters 122. In one embodiment, the cutters 122 are steel cutters that enable more accurate milling of the window in the casing 16. The steel cutters 122 on the mill 112 are distinguished from brazed-on cutters or cutting elements made of abrasive material that are welded or otherwise bonded to the mill 112. However, although steel cutters 122 provide some benefits in terms of more accurate milling of windows in the casing 16, it is contemplated that any type of cutting element on a mill can be used in other embodiments.

The mill 112 is rotatable by a rotating shaft 124. In addition, during milling operation, a downward force can be communicated down the shaft 124 to the mill 112. When the mill 112 is rotated, the cutters 122 are able to cut through the casing 16.

Figure 6:
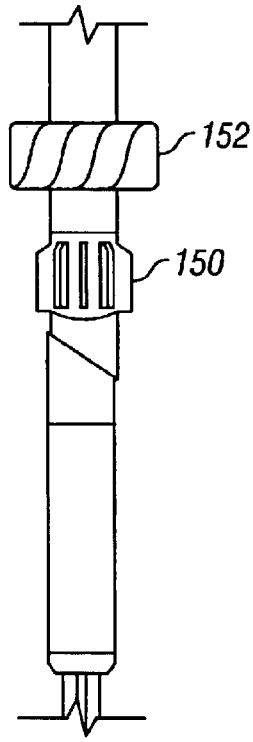
FIG. 6 illustrates a milling assembly having multiple mills, according to another embodiment.

In other embodiments, as shown in FIG. 6, a plurality of mills 150 and 152, such as a stack of mills, can be used. Also, the plurality of mills 150 and 152 can have different diameters and/or cutter characteristics.

The position of FIG. 2 is the initial position of the milling assembly 100. The lower end of the milling tool 104 abuts the reaction surface 110 of the deflector 108. In operation, the shaft 124 is rotated to rotate the mill 112. A downward longitudinal force is also applied on the shaft 124 as the mill 112 is rotated. The downward force causes the mill 112 to slide on the inclined reaction surface 110 of the deflector 108. This causes the mill 112 to start cutting the surrounding casing 16. Continued downward force causes the hydraulic cylinder 116 to slide downwardly on the rods 118, with hydraulic fluid bleeding from the hydraulic cylinder 116 through outlet ports 120 of the hydraulic cylinder 116.

Figure 3:
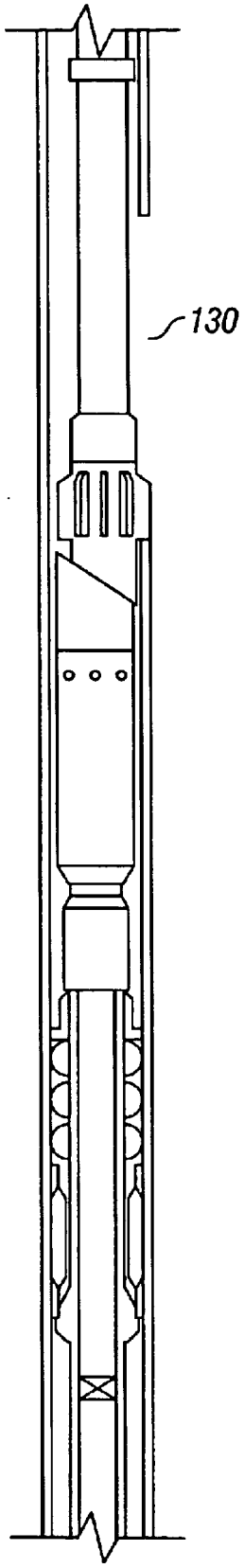
FIG. 3 illustrates the milling assembly engaged with the packer device, with the milling assembly in a second position after the milling assembly has milled a window in the downhole structure.
Figure 4:
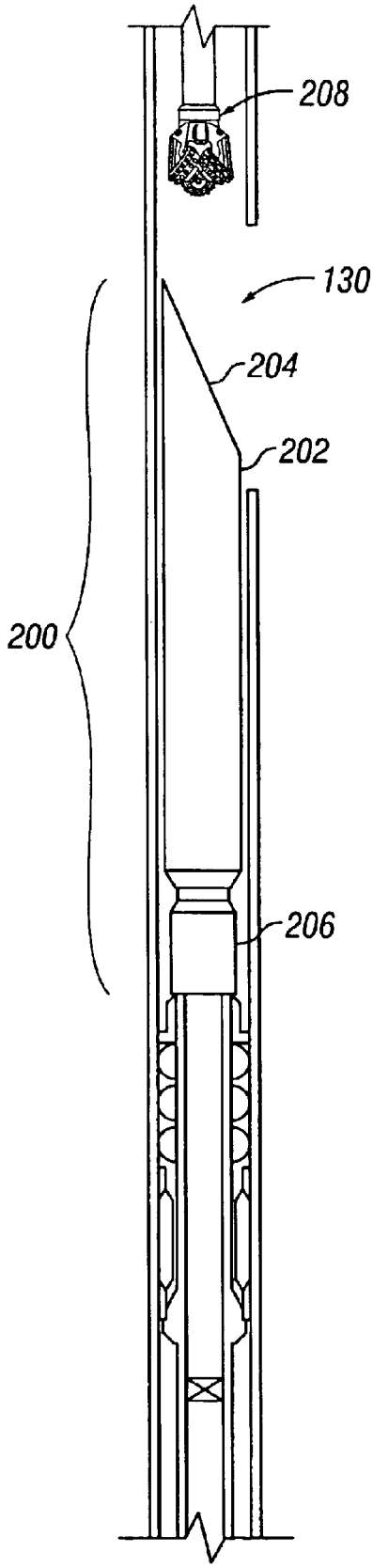
FIG. 4 illustrates a drilling deflector engaged with the packer device, and a drill tool that is guided by the drilling deflector through the milled window to drill a lateral wellbore.

The downward movement of the hydraulic cylinder 116 on the rods 118 causes the thruster section 114 to slowly collapse to the final position shown in FIG. 3. The slow downward, longitudinal movement of the thruster section 114 enables the cutters 122 on the mill 112 to cut the window in an accurate and smooth manner. Thus, as shown in FIG. 3, a window 130 has been cut through the casing 16 with accurate geometrical dimensions.

After the casing window 130 has been cut through the casing 16, a lateral wellbore can be drilled from the casing window 130. This is accomplished by retrieving the milling assembly 100 from the wellbore, followed by the installation of a drilling deflector assembly 200 into the wellbore. The drilling deflector assembly 200 has a drilling deflector 202 with an inclined surface 204, with the deflector 202 connected to a guide device 206 that is engageable with the orienting profile 22 of the packer device 10. Again, engagement of the orienting element or profile in the guide device 206 of the drilling deflector assembly 200 enables the drilling deflector 202 to be oriented in the desired azimuthal orientation (that is, the inclined surface 204 is oriented to guide a drill tool 208 through the lateral window 130 to drill the lateral wellbore). After the lateral wellbore has been drilled, a liner section (310 in FIG. 5) can be set in the lateral wellbore.

Figure 5:
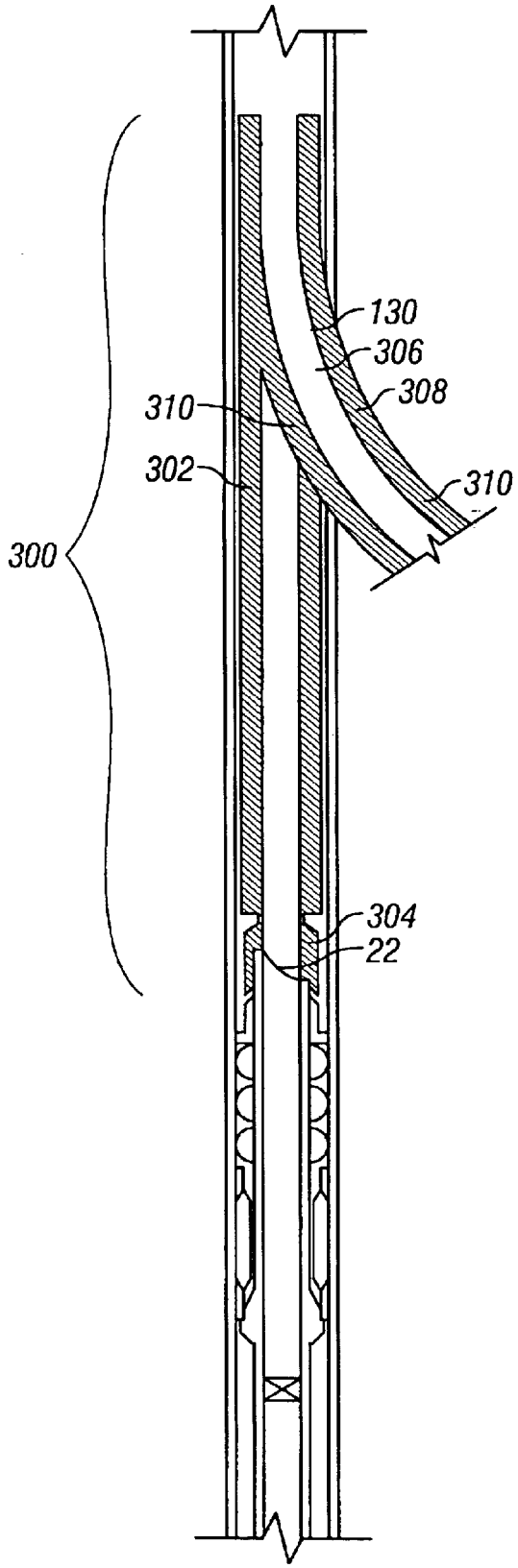
FIG. 5 illustrates a junction assembly engaged with the packer device.

Next, the drill tool 208 and the drilling deflector assembly 200 are retrieved from the wellbore. FIG. 5 illustrates the placement of lateral connection or junction assembly shown generally as 300 within the casing 16. The junction assembly 300 includes a guide device 304 that is engageable with the orienting profile 22 of the packer device 10 to azimuthally orient the junction assembly 300. The junction assembly 300 also includes a lateral branch template 302. The lateral branch template 302 has a side window 306 that is aligned with the casing window 130 once the junction assembly 300 is engaged with and oriented with respect to the orienting profile 22 of the packer device 10

A lateral branch connector 308 is engageable within the lateral branch template 302. A lower end of the lateral branch connector is engageable with a lateral branch liner in the lateral wellbore. A ramp 310 cut at a shallow angle in the lateral branch template 302 to guide the lateral branch connector 308 toward the casing window 130 while sliding downwardly along the lateral branch template 302. Although not shown, seals are also provided to enable the lateral branch template 302 to be sealably engaged with the lateral branch connector 308 to keep out debris. Further details of the junction assembly 300 are described in U.S. Ser. No. 09/789,187, filed Feb. 20, 2001, now U.S. Pat. No. 6,568,469, which is hereby incorporated by reference.

Note, however, that the junction assembly 300 mentioned above is one example of a junction assembly that can be installed in the wellbore. Other junction assemblies can be used in other embodiments.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A milling apparatus to mill a window through a downhole structure having a longitudinal axis, comprising:

a deflector having a reaction surface;

a motion mechanism adapted to move the deflector generally along the longitudinal axis; and a mill adapted to cooperate with the reaction surface and to move generally along the longitudinal axis with the deflector, wherein the motion mechanism comprises a hydraulic mechanism through which hydraulic fluid is bled to move the deflector.

2. The apparatus of claim 1, wherein the hydraulic mechanism includes a container containing the hydraulic fluid and having one or more outlet ports, the hydraulic fluid to be bled through the one or more outlet ports in response to a force applied against the container.

3. The apparatus of claim 2, wherein the hydraulic mechanism further comprises one or more support elements moveably engaged with the container, the container adapted to move along the one or more support elements in response to the force applied against the container.

4. A milling apparatus to mill a window through a downhole structure having a longitudinal axis, comprising:

a deflector having a reaction surface;

a motion mechanism adapted to move the deflector generally along the longitudinal axis;

a mill adapted to cooperate with the reaction surface and to move generally along the longitudinal axis with the deflector; and a guide device with an orienting element adapted to engage a corresponding orienting profile with a known azimuthal orientation.

5. A method of milling a window in a downhole structure in a wellbore, comprising:

setting a deflector in the wellbore, the deflector having a reaction surface, the deflector further having a mechanism to move the deflector generally along a longitudinal axis of the deflector;

engaging a mill against the reaction surface;

rotating the mill; and moving the mill generally along the longitudinal axis with the deflector as the mill cuts the window in the downhole structure.

6. The method of claim 5, further comprising:

providing a landing device having an orienting element; and engaging an orienting element coupled to the deflector to the orienting element of the landing device to set an azimuthal orientation of deflector with respect to the downhole structure.

7. The method of claim 6, further comprising determining an azimuthal orientation of the orienting element of the landing device using a measurement tool.

8. The method of claim 7, wherein using the measurement tool comprises using a gyroscope survey tool.

9. The method of claim 6, further comprising:

after milling the window, retrieving the milling assembly from the wellbore; and installing a junction assembly to form a sealed junction.

10. The method of claim 5, wherein the mechanism to move the deflector comprises a hydraulic mechanism, the method further comprising applying a force to actuate the hydraulic mechanism to move the deflector.

11. The method of claim 10, wherein the hydraulic mechanism comprises a container containing a hydraulic fluid, and wherein applying the force comprises applying a force to bleed the hydraulic fluid from the container.

12. The method of claim 11, further comprising moving the container along one or more support elements as the hydraulic fluid is bled from the container.

13. The method of claim 5, wherein the mechanism comprises a support member, the deflector moveable with respect to the support member, wherein moving the mill generally along the longitudinal axis causes movement of the deflector generally along the longitudinal direction.

14. A system for use in a wellbore, comprising:

a milling assembly, the milling assembly having:

a deflector having a reaction surface;

a motion mechanism adapted to move the deflector generally along a longitudinal axis of the deflector; and a mill adapted to be engaged with the reaction surface and to move generally along the longitudinal axis with the deflector as the mill is rotating.

15. The system of claim 14, wherein the reaction surface is generally inclined to guide the mill against a casing in the wellbore.

16. The system of claim 14, wherein the milling assembly further comprises a rotatable shaft adapted to rotate the mill.

17. The system of claim 14, further comprising:

a casing, wherein the milling assembly is adapted to mill a window through the casing; and a junction assembly having:

a template having a lateral window for positioning proximal the casing window;

a connector adapted to be sealably engaged with the template, the connector adapted to be directed by the template through the template lateral window.

18. The system of claim 14, wherein movement of the mill along the longitudinal axis causes movement of the deflector along the longitudinal axis.

19. The system of claim 14, wherein the motion mechanism comprises at least one support member and a component moveable on the at least one support member, and wherein the deflector is attached to the component such that the deflector is moveable with respect to the support member.

20. The system of claim 19, wherein the milling assembly further comprises a shaft coupled to the mill, wherein a force applied on the shaft as the mill is milling a downhole structure causes movement of the deflector with respect to the support member.

21. The system of claim 14, wherein the milling assembly further comprises a shaft coupled to the mill, wherein a force applied on the shaft as the mill is milling a downhole structure causes movement of the deflector with respect to the support member.

22. A system for use in a wellbore, comprising:

a milling assembly, the milling assembly having:

a deflector having a reaction surface;

a motion mechanism adapted to move the deflector generally along a longitudinal axis of the deflector; and a mill adapted to be engaged with the reaction surface and to move generally along the longitudinal axis with the deflector, wherein the motion mechanism comprises a hydraulic mechanism through which hydraulic fluid is bled to move the deflector.

23. The system of claim 22, wherein the hydraulic mechanism includes a container containing the hydraulic fluid and having one or more outlet ports, the hydraulic fluid to be bled through the one or more outlet ports in response to a force applied against the container.

24. The system of claim 23, wherein the hydraulic mechanism further comprises one or more support elements moveably engaged with the container, the container adapted to move along the one or more support elements in response to the force applied against the container.

25. A system for use in a wellbore, comprising:

a milling assembly, the milling assembly having:

a deflector having a reaction surface;

a motion mechanism adapted to move the deflector generally along a longitudinal axis of the deflector; and a mill adapted to be engaged with the reaction surface and to move generally along the longitudinal axis with the deflector; and a landing device having an orienting profile with a known azimuthal orientation in the wellbore.

26. The system of claim 25, wherein the milling assembly further comprises a guide device with an orienting element adapted to engage the orienting profile of the landing device.

27. A milling apparatus to mill a window through a downhole structure having a longitudinal axis, comprising:

a deflector having a reaction surface;

a motion mechanism adapted to move the deflector generally along the longitudinal axis; and a mill adapted to cooperate with the reaction surface and to move generally along the longitudinal axis with the deflector, wherein the mill is adapted to move with the deflector along the longitudinal axis as the mill is milling the downhole structure.

28. The milling apparatus of claim 27, wherein movement of the mill along the longitudinal axis causes movement of the deflector along the longitudinal axis.

29. The apparatus of claim 27, further comprising a support bearing adapted to support the mill, the support bearing being in engagement with the reaction surface.

30. The apparatus of claim 27, wherein the mill has a first size, the apparatus further comprising a second mill having a second, different size.

31. A The apparatus of claim 27, wherein the mill has a first cutting structure, the apparatus further comprising a second mill having a second, different cutting structure.

32. The apparatus of claim 27, wherein the mill is maintained in a fixed azimuthal orientation with respect to the downhole structure.

33. The apparatus of claim 27, further comprising a rotatable shaft adapted to rotate the mill.

34. The apparatus of claim 27, wherein the reaction surface is generally inclined to guide the mill against the downhole structure.

35. The milling apparatus of claim 27, wherein the motion mechanism comprises at least one support member and a component moveable on the at least one support member, and wherein the deflector is attached to the component such that the deflector is moveable with respect to the support member.

36. The milling apparatus of claim 35, further comprising a shaft coupled to the mill, wherein a force applied on the shaft as the mill is milling the downhole structure causes movement of the deflector with respect to the support member.

37. The milling apparatus of claim 27, further comprising a shaft coupled to the mill, wherein a force applied on the shaft as the mill is milling the downhole structure causes movement of the deflector with respect to the support member.

38. A system for use in a wellbore, comprising:

a milling assembly, the milling assembly having:

a deflector having a reaction surface;

a motion mechanism adapted to move the deflector generally along a longitudinal axis of the deflector; and a mill adapted to be engaged with the reaction surface and to move generally along the longitudinal axis with the deflector, wherein the mill is adapted to move with the deflector along the longitudinal axis as the mill is milling a downhole structure.

* * * * *